US007147034B2

(12) United States Patent
Clayton

(10) Patent No.: US 7,147,034 B2
(45) Date of Patent: Dec. 12, 2006

(54) RECLAMATION TREATMENT OF BONDED PARTICULATES

(75) Inventor: Christopher Clayton, West Midlands (GB)

(73) Assignee: Clayton Thermal Processes Limited (GB)

( * ) Notice: Subject to any disclaimer, the term of this patent is extended or adjusted under 35 U.S.C. 154(b) by 0 days.

(21) Appl. No.: 10/473,988

(22) PCT Filed: Apr. 5, 2002

(86) PCT No.: PCT/GB02/01605

§ 371 (c)(1),
(2), (4) Date: Oct. 3, 2003

(87) PCT Pub. No.: WO02/081127

PCT Pub. Date: Oct. 17, 2002

(65) Prior Publication Data

US 2004/0134633 A1 Jul. 15, 2004

(30) Foreign Application Priority Data

Apr. 5, 2001 (GB) ..... 0108619.8
Oct. 4, 2001 (GB) ..... 0123874.0

(51) Int. Cl.
*B22C 5/00* (2006.01)

(52) U.S. Cl. ..... 164/456; 164/5

(58) Field of Classification Search ..... 164/5, 164/412, 456

See application file for complete search history.

(56) References Cited

U.S. PATENT DOCUMENTS

| | | | | |
|---|---|---|---|---|
| 3,685,165 | A | 8/1972 | Deve | |
| 4,436,138 | A * | 3/1984 | Kondo | 164/5 |
| 4,573,417 | A * | 3/1986 | Deve | 110/236 |
| 4,739,937 | A * | 4/1988 | Carpenter et al. | 241/79.1 |
| 5,251,684 | A * | 10/1993 | Andrews et al. | 164/456 |
| 5,382,002 | A | 1/1995 | Evans et al. | |
| 5,706,879 | A * | 1/1998 | Renner et al. | 164/5 |
| 5,992,499 | A * | 11/1999 | Tordoff et al. | 164/5 |
| 6,401,798 | B1 * | 6/2002 | Kondo | 164/412 |
| 6,691,765 | B1 * | 2/2004 | Sparks et al. | 164/5 |

FOREIGN PATENT DOCUMENTS

| | | |
|---|---|---|
| CH | 575 262 A | 5/1976 |
| DE | 44 34 115 C | 11/1995 |

OTHER PUBLICATIONS

International Search Report for Application No. PCT/GB02/01605.

* cited by examiner

*Primary Examiner*—Len Tran
(74) *Attorney, Agent, or Firm*—Caesar, Rivise, Bernstein, Cohen & Pokotilow, Ltd.

(57) ABSTRACT

Apparatus for use in reclaiming particulate material from bonded particulate material comprises an outer compartment arranged substantially concentrically about an inner compartment, means in one compartment for breaking up the bonded particulate material and means in the other compartment for removing the binder, and means for transferring broken up material from one compartment to the other.

35 Claims, 3 Drawing Sheets

RECLAMATION TREATMENT OF BONDED PARTICULATES

The invention relates to the treatment of bonded particulate material and more particularly to the recovery or reclamation of sand in cores in the casting of articles of molten metal or alloy for its subsequent reuse.

It is known to use vibration devices to remove the cores from the castings. Such apparatus can be noisy. The vibration devices can cause industrial diseases such as white finger, hand and arm vibration syndrome and the like.

Because of such problems, other processes and apparatus have been proposed.

EP-B1-0612276 (CEC) discloses the use of a combined heat-treatment furnace and sand reclamation apparatus, the furnace sitting above the sand reclamation apparatus. A casting with a core is held in the furnace and is exposed to a heated atmosphere. As the casting heats up, the sand core loosens and eventually falls from the casting into the sand reclamation unit. Oxygenated air is introduced to the sand reclamation apparatus which fluidises the bed; the air may be heated also. The attrition of the particles of sand within the fluidized bed together with the heat which may be present act to remove, by abrasion and/or combustion, binder which adheres to the sand. The casting is retained within the furnace to effect heat treatment thereof.

U.S. Pat. No. 5,423,370 (PROCEDYNE) discloses a process for removing the sand cores from a metal casting which comprises placing the casting in a fluidized bed and heating the casting to a temperature sufficient to pyrolyse the sand core binder. Pyrolysis of the sand core binder causes the sand to return to particulate form and be assimilated with the fluidised bed.

It is an object of this invention to provide apparatus and a method for reclamation of cores of bonded particulate material which is more compact and energy efficient.

In one aspect the invention provides apparatus for use in reclaiming particulate material from bonded particulate material, the apparatus comprising an outer compartment arranged substantially concentrically about an inner compartment, means in one compartment for breaking up the bonded particulate material and means in the other compartment for removing the binder, and means for transferring broken up material from one compartment to the other.

Preferably the means for breaking up the bonded material is thermal reaction caused by locating the material, typically a sand core on a casting, in a fluidised bed of loose particulate material.

Preferably the means for removing the binder is heat at a temperature sufficient to burn off the binder. A fluidised bed of loose particulate material is advantageously present.

The temperature of the inner and outer compartments may be controlled by heating means arranged to heat at least one wall of each compartment to heat, and hold, the contents of each compartment to and at a desired temperature heat.

Preferably the transfer means is a weir or the like, in a wall common to the compartments. The transfer means may also be a chute, passageway or the like defining a path between the outer and inner compartments.

The outer compartment may have two or more partitions, to define two or more distinct compartments. The or each compartment may be held at the same or at a different temperature.

The inner compartment may comprise an inlet and an outlet, means for fluidising the particulate material to cause it to flow from the inlet to the outlet and means for regulating the flow of the particulate material from the inlet to the outlet to allow sufficient exposure to the heat to remove the adherent binder from the particulate material.

A second aspect of the invention provides apparatus useful in the reclamation of bonded particulates, the apparatus being for removing adherent binder from particulate material by the application of heat, the apparatus having an inlet and an outlet, means for fluidising the particulate material to cause it to flow from the inlet to the outlet and means for regulating the flow of the particulate material from the inlet to the outlet to allow sufficient exposure to the heat to remove the adherent binder from the particulate material.

The regulating means may comprise at least two spaced apart baffles. The baffles may each comprise an overweir or an underweir. In a preferred embodiment one baffle is an overweir and the other is an underweir. The inner compartment may comprise more than two baffles, say four, two providing overweirs and two providing underweirs, so that the particulate material flows along a tortuous path between the inlet and outlet.

The inner compartment may further comprise mesh partitions to slow the flow of particulate material from the inlet to the outlet.

In another aspect the invention provides a method of reclaiming particulate material from bonded particulate material, the method comprising breaking up the bonded particulate material in one compartment of a dual compartment apparatus, the compartments being substantially concentric, passing the broken material into the other compartment and removing the binder to provide binder-free loose particulate material.

The apparatus preferably further includes means for cooling the binder-free loose particulate material to a predetermined temperature and the method preferably includes the step of cooling to a predetermined temperature. Conveniently the cooling means is a heat exchanger, e.g. a set of coils.

In another aspect of the invention there is provided apparatus for use in reclaiming particulate material by removing the binder from bonded particulate material, the apparatus comprising an outer compartment disposed about an inner compartment, each having a perforate floor at least one containing loose binder-free material, means for the transfer of loose binder-containing material from one compartment to the other, and means for supplying gas at a predetermined temperature to the respective compartment.

The loose sand in the outer compartment is fluidised by passing gas, typically ambient air, through the perforated floor. When binder-containing loose sand is in the inner compartment it is fluidised and heated to a high temperature to burn off the binder. For this reason the gas supplied to the outer compartment is at a lower temperature than that supplied to the inner compartment.

While the cores could be detached from castings and then treated in apparatus of the invention, preferably castings and the attached cores are placed in the outer compartment which contains the loose sand or the like. This bed is then fluidised so that the cores are separated from the castings by thermal reaction in the outer compartment and the detached core material is transferred to the inner compartment where the binding agent is removed. Once the sand has been detached from the casting the casting itself may need to undergo a heat treatment, e.g. ageing or cleaning process. If heat-treatment of a casting is required heat treatment means will be provided in which the at least substantially sand-free casting can be located for this to take place. Preferably the heat treatment means will comprise a heated fluidised bed of preferably virgin or clean sand. The casting is located in the loose sand and the heat treatment or cleaning is carried out in known manner.

Preferably the apparatus also includes heat exchange means to recover heat from the waste gas from the inner compartment for use in heating gas used to fluidise the loose particulate material in the outer compartment.

It will be understood that the apparatus is made up of a number of components and that each may be made as an independent unit and used as such or joined with other components useful in the process of reclamation.

According to the invention in another aspect there is provided a method of reclaiming loose particulate material from bonded particulate material in multi-compartment apparatus, each compartment having a perforate floor, one compartment containing binder-free loose particulate material, the method comprising placing the material to be treated in the one compartment, passing gas at elevated temperature into the one compartment to fluidise the loose material to break up the bonded material to release the bonded particles, passing the released particles into the second compartment and passing gas at a higher temperature through the perforate floor of the second compartment to remove the binding agent.

A yet further aspect of the invention provides a method of removing adherent binder from particulate material by the application of heat, the method comprising causing particulate material having adherent binder to flow from an Inlet to an outlet of a compartment therefor by fluidising a bed of particulate material and heating the fluidised bed, the method including the step of regulating the flow of particulate material between the inlet and outlet to allow sufficient exposure of the material to the heat to remove the adherent binder.

In order that the invention may be fully understood it will now be described, by way of illustration only, with reference to the accompanying drawings; in which.

Figure 1:
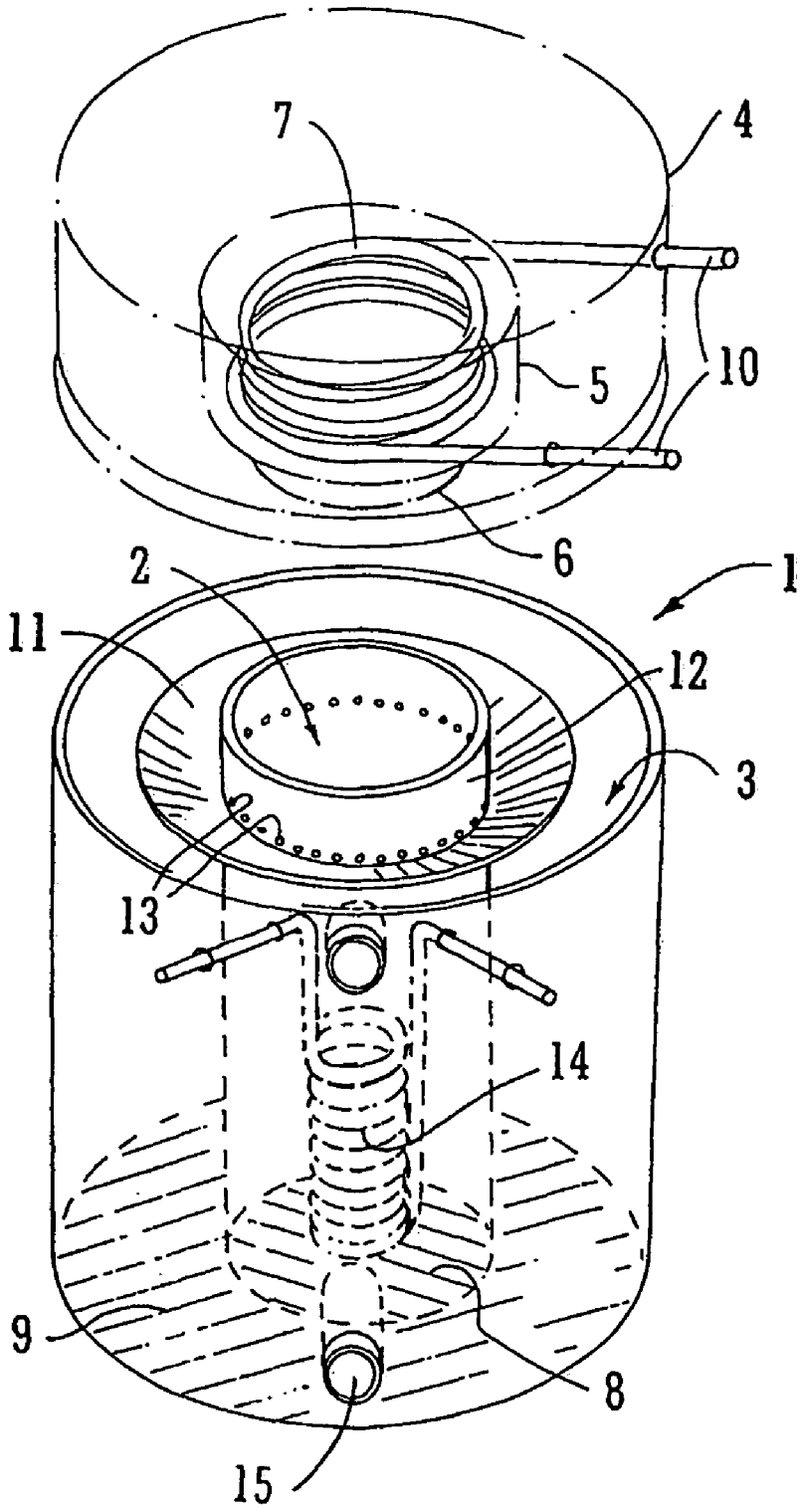
FIG. 1 is an exploded perspective view of one unit of the invention.

The apparatus 1 of FIG. 1 comprises two substantially concentric compartments, one 2 being an inner compartment and the other being an outer compartment 3. A hood portion 4 is connected to the upper rim of the outer compartment 3. The hood portion 4 contains pipe-work for the flow of gas. Within the hood portion 4 is a smaller hood portion 5, having a neck portion 6, which is received in the upper end of the inner compartment 2. The pipe-work provides a heat exchanger unit 7 located within the hood portion 5. The inner compartment 2 and the outer compartment 3 each have a perforate floor supporting sand forming a fluidised bed 8,9 respectively. The heat exchanger 7 is connected to pipes 10 which transfer heat from waste gas in the inner compartment to the fluidised bed 9 of the outer compartment 3.

An overflow chute 11 is present between the inner compartment 2 and outer compartment 3 for transferring material from the outer compartment 3 to the inner compartment 2. A vertical wall 12 is present to prevent oversized agglomerates of bonded material from the outer compartment 3, which pass along the chute 11, from entering the inner compartment 2. Holes 13 are present in the vertical wall 12 to allow released bonded particulate material of a suitable size to fall into the inner compartment 2. A cooling coil 14 is present in a zone of the inner compartment 3.

An outlet 15 is situated in the base of the cooling zone 2 for removing the reclaimed material. An outlet 16 is present in the inner compartment to allow reclaimed sand to pass into the cooling zone.

In one specific use, metal or alloy castings (not shown) each containing one or more cores of bonded sand are loaded into open baskets (not shown) which are placed into the outer compartment 3 containing loose binder-free virgin sand. The hood portions 4 and 5 are locked in place. Heated air is supplied to the fluidised beds 8 and 9 from below. The air entering the fluidised bed 8 of the inner compartment 2 is heated electrically by external heating elements (not shown). The heat from the waste hot gas is extracted by the heat exchanger 7, which transfers the heat via pipes 10 to the air supply to the fluidised bed 9 of the outer compartment. Due to the presence of the electrical heating element around the inner compartment 2, the inner compartment 2 is maintained at a higher temperature than the outer compartment 3.

Because the castings in the outer compartment are in the heated fluidised sand the cores are subjected to thermal reaction. The heat introduced into the outer compartment 3 loosens or breaks up the bonded sand in the cores of the castings.

As the cores of all of the castings are recovered the level of sand in the outer compartment 3 will rise, and eventually reach the level of the overflow chute 11. As the loose sand flows down the chute, particles small enough will pass through holes 13 into the inner compartment 2. (Large particles of sand are prevented from entering the inner compartment 2 by the vertical wall 12. They can be returned to the outer compartment or broken up in another way.) The baskets containing sand-free castings are removed from the outer compartment 3.

The agitation of the fluidised bed 8 and the high temperature within the inner compartment causes the binding agent on the surface of the bonded sand to burn off or be released by thermal shock. The bonding agent may be resin based or inorganic. The waste gases produced are removed from the inner compartment 2 by a ventilation system (not shown). Once the process is complete the reclaimed clean sand is removed from the inner compartment 2 via outlet 15. The sand may be reused in casting in a mould, in die castings or the like.

By having two compartments, one inside the other, the furnace takes up little space and the capital cost is reduced. By splitting the treatment of the bonded particulate material into two stages and using heat energy from one in the other, the running costs are reduced. The method can be quiet because vibration equipment is not used.

Figure 2:
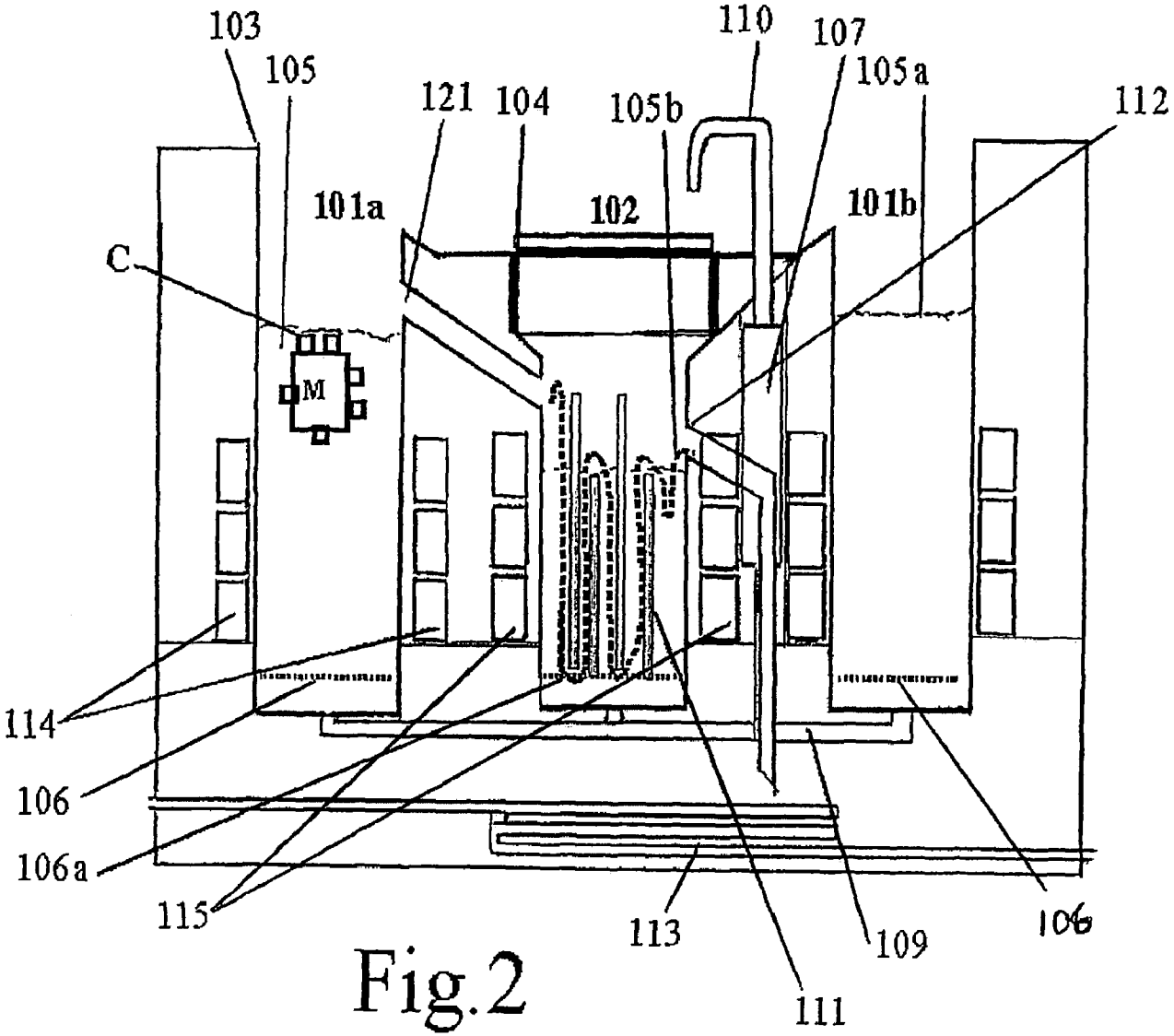
FIG. 2 is a vertical section of another unit of the invention.
Figure 3:
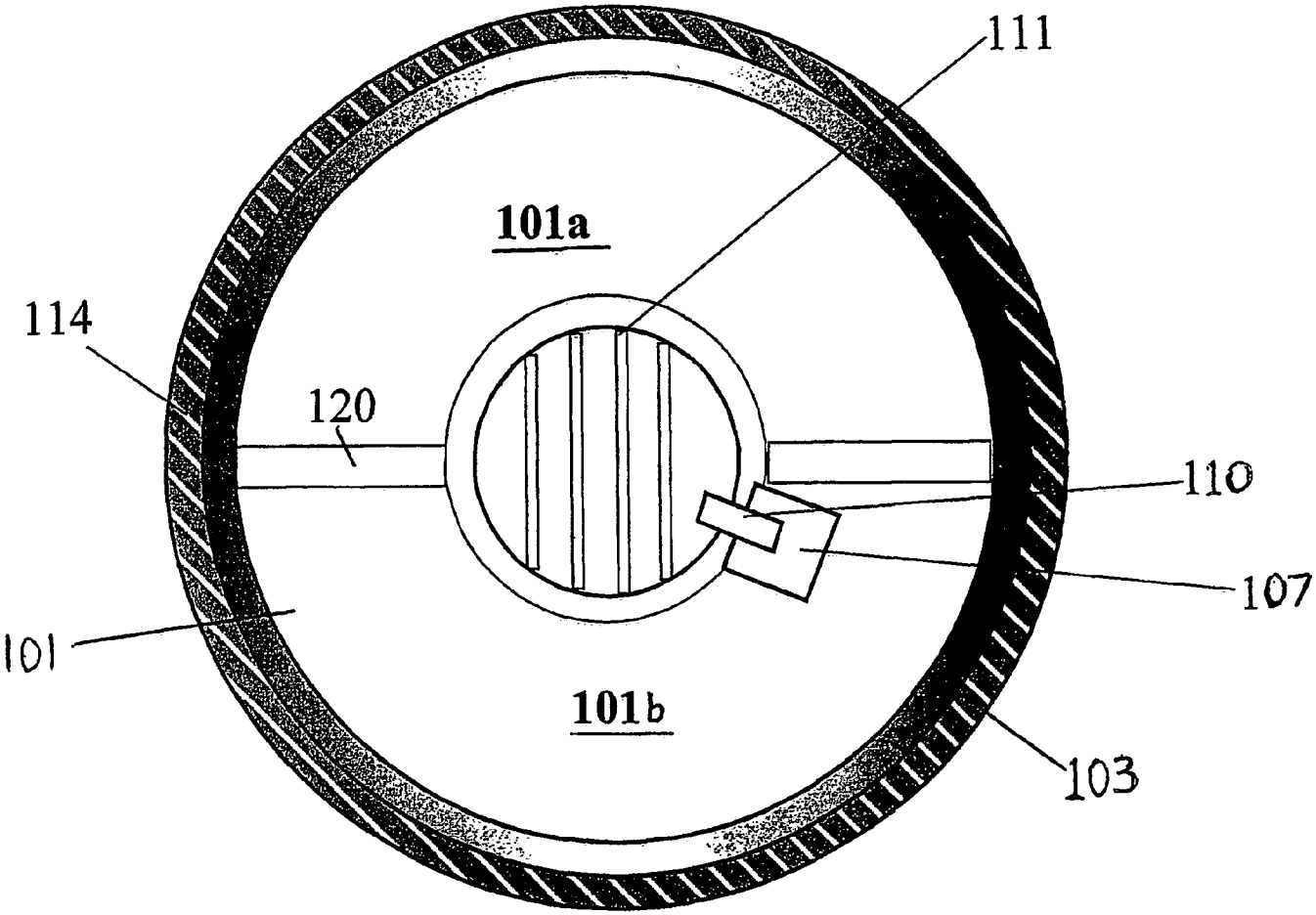
FIG. 3 is a top plan view of the unit of FIG. 2.

The apparatus shown in FIGS. 2 and 3 comprises an annular outer chamber 101, split into two halves by radial partitions 120 to form separate and distinct chambers 101*a* and 101*b*, and an inner circular chamber 102. The outer chamber 101 has an outer circular wall 103, and an inner circular wall. A circular wall 104 defines the inner chamber 102. The outer chambers 101*a* and 101*b* contain beds of sand 105, 105*a* respectively, on a perforate floor or platform 106. The inner chamber 102 has a perforate floor 106*a* and will receive sand from the outer chamber 101*a* to form a bed 105*b* via a chute 121.

The inner chamber 102 has vertical partitions 111. The partitions 111 provide a series of weirs arranged to allow the particulate material to flow either thereover or thereunder to define a tortuous path from the inlet via chute 121 to an outlet 112, as shown by the arrow. Beneath the exit of chute

112 is a bank of cooling pipes 113. Heat packs 114 are present on the walls which define the outer chamber 101 and adjacent the wall 104.

A heat exchanger unit 107 is present near the wall 104. Hot air is drawn from the upper regions of the inner chamber 102 via pipe 110 into the heat exchanger 107.

Chamber 101*b* may be used as a place in which to heat treat, e.g. a casting M from which cores C have been removed. The casting M is placed on loose clean sand in that chamber 101*b* and left for a pre-determined period at the temperature of the sand for ageing or the like.

In use, virgin sand is placed in the outer chambers 101*a* and 101*b* to form the beds 105 and 105*a*. The heat packs 114 are activated to heat the sand of bed 105, up to say 500° C. and the sand of bed 105*a* to say 520° C. and air is passed via pipe 109 to fluidise the sand 105, 105*a* forming a gently bubbling fluidised beds. The temperature of bed 105 is selected to break up the core and not to affect the metallurgy of the casting C during de-coring. The casting M having cores C of bonded sand is placed in the bed of sand 105. Thermal reaction cause the cores C to decore from the casting M and also to break up into small pieces once the casting M has reached the fluid bed temperature. The casting M is left within the bed 105 for, typically 30 minutes, to ensure complete core removal. As the level of sand in the outer chamber 101*a* rises because the released material is added to the level of the virgin sand, some flows via the chute 121 into the inner chamber 102.

The bed 105*b* of the inner chamber 102 is fluidised by supplying air from pipe 109. The heat packs 115 are activated to ensure that temperature of the inner chamber 102 is about 700° C., which is usually enough for complete burn off or removal of the binder over a period of time. The partitions 111 define a tortuous path for the particulate material to describe. The tortuous flow path ensures that the sand entering the bed 105*b* has a sufficient residence time within the chamber 102 to ensure complete removal of the binder. Binder-free sand falls down the chute 112 to the cooling pipes 113. These contain flowing water, and the size of the pipes and the rate of flow are adjusted to cool the binder-free sand to a pre-determined temperature. This will be from about 30° C. to about 40° C. dependent on the temperature at which the sand should be mixed with fresh binder for reuse.

Computer controls may control the temperature in the chambers 101*a*, 101*b*, 102. A time control may be present to indicate that the casting has been in the de-coring chamber 101*a* for time enough to effect de-coring. When an alarm may sound and/or the castings may be automatically lifted from the chamber 101*a*.

The total apparatus requires little floor space, which is much reduced compared to prior apparatus. Temperature controls, preferably electrical or electronic controls, may be used to control the cooling water in the pipes of the coils 113. It must be emphasised that each compartment is separate and the individual treatments can be performed separately.

For example, whilst we have described the outer chamber 101 as being separated into two chambers 101*a* and 101*b* by partitions 120, the chambers 101*a* and 101*b* may in fact be two separate units placed together. Further, chamber 102 may be configured to accept used and broken-down sand from cores from any source.

The invention claimed is:

1. Core removal and reclamation apparatus for removing cores comprising bonded particulate material from castings and reclaiming the particulate material from the cores, the apparatus comprising an outer compartment arranged substantially concentrically about an inner compartment, a heated fluidised bed means comprising loose particulate material in one compartment for removing the cores from the castings and breaking up the cores and a heated fluidised bed means comprising loose particulate material in the other compartment for removing the binder from the broken up material, and means for transferring broken up material from one compartment to the other.

2. Apparatus according to claim 1, wherein said means for transferring is a chute chute or passageway defining a path between the outer and inner compartments or a weir in a wall common to the two compartments.

3. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other, the apparatus further comprising heating means arranged to heat at least one wall of each compartment to heat, and hold, the contents of each compartment to and at a desired temperature.

4. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other wherein each compartment has separate heating means arranged to hold each at the same or at a different temperature.

5. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other wherein the compartment for breaking up the cores of bonded particulate material and the other compartment for removing the binder from the broken up material are arranged to be heated to different temperatures.

6. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other wherein the outer compartment has two or more partitions, to define two or more distinct chambers.

7. Apparatus according to claim 6, wherein each distinct chamber is arranged to be heated to a different temperature.

8. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other wherein one compartment comprises an inlet, arranged to accept broken down particulate material from said transfer means and an outlet, said fluidised bed means causing the particulate material to flow from the inlet to the outlet; and means for regulating the flow of the particulate material from the inlet to the outlet to allow sufficient exposure of the particulate material to the heat to remove the adherent binder from the particulate material.

9. Apparatus according to claim 8, further comprising heating means to heat the entire fluidised bed between inlet and outlet to a temperature sufficient to remove adherent binder from the particulate material.

10. Apparatus according to claim 8, wherein said flow regulating means comprises at least one baffle.

11. Apparatus according to claim 9, wherein said flow regulating means comprises at least one baffle.

12. Apparatus according to claim 10, wherein said flow regulating means comprises at least two spaced apart baffles.

13. Apparatus according to claim 12, wherein the baffles each provide an overweir or an underweir.

14. Apparatus according to claim 12, wherein one baffle provides an overweir and another baffle provides an underweir.

15. Apparatus according to claim 11, wherein said regulating means comprises four baffles, providing sequential overweirs and underweirs, arranged to ensure that the particulate material flows along a tortuous path between the inlet and outlet.

16. Apparatus according to claim 10, wherein said flow regulating means further comprises mesh partitions to slow the flow of particulate material from the inlet to the outlet.

17. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other, said apparatus further comprising heat exchange means to recover at least some of any heat from the waste gas from the compartment in which binder is removed from broken down particulate material for use in heating gas used to fluidise the loose particulate material in said one compartment.

18. Apparatus for the reclamation of particulate material from cores of bonded particulate material, the apparatus comprising an outer compartment arranged substantially concentrically about an inner compartment, heated fluidised bed means comprising loose particulate material in one compartment for breaking up the cores of bonded particulate material and heated fluidised bed means comprising loose particulate material in the other compartment for removing the binder from the broken up material, and means for transferring broken up material from one compartment to the other said apparatus further comprising means for cooling binder-free loose particulate material exiting therefrom to a predetermined temperature.

19. A method of reclaiming particulate material from cores of particulate material bonded by a binding agent in a dual compartment apparatus comprising a first compartment and a second compartment, the compartments being concentric, the method comprising breaking up cores of bonded particulate material in a heated fluidised bed located in the first compartment, and passing the broken material into the second compartment and removing the binder from the broken-down material in a second heated fluidised bed located in the second compartment to provide binder-free loose particulate material.

20. A method according to claim 19, wherein each compartment has a perforate floor and the fluidised bed in said first compartment comprises binder-free loose particulate material, the method comprising placing the cores of bonded particulate material in the first compartment, passing gas at elevated temperature into the first compartment to fluidise said loose material to break up the cores of bonded particulate material to release the bonded particles, passing the released particles into the second compartment and passing gas at a higher temperature through the perforate floor of the second compartment to remove the binding agent from the released particles.

21. A method according to claim 19, including the step of regulating the flow of released particles between the inlet and outlet of the second compartment to allow sufficient exposure to heat to remove the binding agent from the released particles.

22. Apparatus useful in the reclamation treatment of particles bonded together by an adherent binder, the apparatus comprising: an inner chamber and an annular outer chamber disposed about said inner chamber, the outer chamber being adapted to receive a plurality of castings containing cores made of particles bonded by an adherent binder and house a fluidised bed of binder free particles which, in use, acts to break up the cores and thereby release the particles with adherent binder from the castings, and having an outlet arranged such that when the volume of particles in the outer chamber reaches a predetermined level, said particles can flow from the outer chamber, and the inner chamber having an inlet for receiving particles flowing from the outlet of the outer chamber and an outlet being adapted to house a heated fluidised bed and defining a winding path through said heated fluidised bed between said inlet and outlet for the particles flowing from the outer chamber to allow sufficient exposure of the particles to the heat of the heated fluidised bed to remove the adherent binder; and heating means to heat the entire heated fluidised bed in the inner chamber to a temperature sufficient to remove adherent binder from the particles.

23. Apparatus according to claim 22, wherein said winding path is defined by at least one baffle.

24. Apparatus according to claim 22, wherein said winding path is defined by at least two spaced apart baffles.

25. Apparatus according to claim 24, wherein each baffle comprises an overweir or an underweir.

26. Apparatus according to claim 24, wherein one baffle is an overweir and one is an underweir.

27. Apparatus according to claim 22, wherein said winding path is defined by four baffles that provide sequential overweirs and underweirs.

28. Apparatus according to claim 27, wherein said flow regulating means further comprises mesh partitions to slow the flow of particulate material from the inlet to the outlet.

29. Apparatus according to claim 22, further comprising heat exchange means to recover at least some of any heat from the waste gas from the compartment in which binder is removed from broken down particulate material for use in heating gas used to fluidise loose particulate material in a compartment in which cores of bonded particulate material are broken down.

30. Apparatus according to claim 22, further comprising means for cooling binder-free loose particulate material exiting therefrom to a predetermined temperature.

31. A method of reclaiming particulate material from cores of bonded particulate material in a multi-compartment apparatus, each compartment having a perforate floor and a first said compartment containing binder-free loose particulate material, the method comprising placing the cores comprising bonded particulate material to be treated in said first compartment, passing gas at elevated temperature into the first compartment to fluidise the binder-free loose particulate material to break up the cores to release the bonded particles, passing the released particles into a second said compartment and passing gas at a higher temperature through the perforate floor of the second compartment to remove the binding agent from the particles.

32. A method of removing from castings cores that comprise particulate matter bonded by an adherent binder and removing the adherent binder from the particulate material by the application of heat, the method comprising placing a plurality of castings containing cores that comprise particulate material bonded by an adherent binder in a fluidised bed housed in a first compartment and heating said fluidised bed to cause break up of said cores and removal of the broken up particulate material from the castings, causing the broken up particulate material to flow from an inlet to an outlet of a second compartment through a fluidised bed of particulate material housed in the second compartment, heating the entire fluidised bed in the second compartment to a predetermined temperature sufficient to remove the adherent binder, and using weirs to regulate the flow of broken up particulate material between the inlet and outlet to allow sufficient exposure of the broken up particulate material to the heat of the fluidised bed to remove the adherent binder from the particles.

33. A method according to claim 19, comprising loading at least one casting comprising a said core into said first compartment, wherein breaking up the core separates the core from the casting to provide a coreless casting.

34. A method according to claim 33, comprising subsequently heat treating the coreless.

35. A method according to claim 33, wherein said first compartment comprises a first chamber and a second chamber and said heated fluidised bed is located in the first chamber and the heat treating of the coreless casting takes place in said second chamber.

* * * * *